US010227544B2

(12) United States Patent
Kim et al.

(10) Patent No.: US 10,227,544 B2
(45) **Date of Patent: *Mar. 12, 2019**

(54) AUTOMOTIVE TRANSMISSION FLUID COMPOSITIONS FOR IMPROVED ENERGY EFFICIENCY

(71) Applicant: Infineum International Limited, Abingdon (GB)

(72) Inventors: Hahn Soo Kim, Bedminster, NJ (US); Joseph R. Noles, Jr., Belle Mead, NJ (US); Raymond F. Watts, Long Valley, NJ (US)

(73) Assignee: INFINEUM INTERNATIONAL LIMITED, Abingdon, Oxfordshire (GB)

( * ) Notice: Subject to any disclaimer, the term of this patent is extended or adjusted under 35 U.S.C. 154(b) by 86 days.

This patent is subject to a terminal disclaimer.

(21) Appl. No.: 13/967,560

(22) Filed: Aug. 15, 2013

(65) Prior Publication Data

US 2015/0051131 A1 Feb. 19, 2015

(51) Int. Cl.

*C10M 145/22* (2006.01)
*C10M 157/00* (2006.01)
*C10M 165/00* (2006.01)

(52) U.S. Cl.

CPC ..... *C10M 145/22* (2013.01); *C10M 157/00* (2013.01); *C10M 165/00* (2013.01); *C10M 2205/028* (2013.01); *C10M 2207/262* (2013.01); *C10M 2209/084* (2013.01); *C10M 2219/046* (2013.01); *C10N 2230/02* (2013.01); *C10N 2230/06* (2013.01); *C10N 2230/54* (2013.01); *C10N 2240/02* (2013.01)

(58) Field of Classification Search

CPC ..... C10N 2230/54; C10N 2240/042; C10N 2240/044; C10N 2240/045
USPC ..... 508/469, 591
See application file for complete search history.

(56) References Cited

U.S. PATENT DOCUMENTS 3,254,025 A 5/1966 Le Suer
3,382,172 A 5/1968 Lowe
3,480,548 A 11/1969 Hellmuth et al.
3,502,677 A 3/1970 Le Suer
3,679,584 A 7/1972 Hellmuth
3,829,381 A 8/1974 Le Suer
3,909,691 A 9/1975 Wilson et al.
4,105,571 A 8/1978 Shaub et al.
4,857,214 A 8/1989 Papay et al.
4,965,003 A 10/1990 Schlicht
4,965,004 A 10/1990 Schlicht et al.
5,314,633 A 5/1994 Ryer et al.
5,641,733 A * 6/1997 Bloch et al. ..... 508/232
5,854,181 A * 12/1998 Na ..... C10M 141/10 508/180
5,942,472 A * 8/1999 Watts et al. ..... 508/291
6,262,000 B1 * 7/2001 Reeve ..... C10M 141/10 508/371
7,129,197 B2 * 10/2006 Song ..... C07C 2/34 508/591
7,732,389 B2 * 6/2010 Sullivan ..... C10M 169/04 508/110
8,268,762 B2 * 9/2012 Fujita ..... C10M 105/04 208/18
8,410,035 B2 * 4/2013 Kaneshige et al. ..... 508/591
8,455,416 B2 * 6/2013 Bagheri ..... C10M 107/10 508/591
8,642,519 B2 * 2/2014 Fewkes ..... 508/188
8,748,361 B2 * 6/2014 Wu ..... C07C 5/05 508/591
8,889,931 B2 * 11/2014 Luo ..... C10M 107/10 585/18
2005/0192186 A1 * 9/2005 Iyer et al. ..... 508/469
2006/0217273 A1 * 9/2006 Ozbalik ..... C10M 133/00 508/269
2007/0000807 A1 1/2007 Wu et al.
2007/0145924 A1 6/2007 Obayashi
2007/0270320 A1 * 11/2007 Itou et al. ..... 508/469
2007/0293406 A1 * 12/2007 Henly et al. ..... 508/185
2007/0298990 A1 * 12/2007 Carey ..... C10M 111/04 508/591
2008/0146475 A1 * 6/2008 Mueller ..... C08F 220/36 508/469
2009/0005279 A1 * 1/2009 Wu ..... C08F 10/14 508/591
2010/0035778 A1 2/2010 Fewkes
2010/0190671 A1 7/2010 Stoehr et al.
2010/0269781 A1 * 10/2010 Derevjanik ..... C10M 163/00 123/196 R
2012/0329694 A1 * 12/2012 Gelder ..... C10M 145/14 508/468
2013/0210996 A1 * 8/2013 Wu ..... C08F 10/14 524/579
2014/0113847 A1 * 4/2014 Givens et al. ..... 508/468
2014/0162924 A1 * 6/2014 Watts et al. ..... 508/591
2014/0364349 A1 * 12/2014 Knapton ..... C10M 169/041 508/235
2015/0051129 A1 * 2/2015 Kim et al. ..... 508/391

OTHER PUBLICATIONS

Smalheer, C.V. and Smith, R. Kennedy, Lubricant Additives, Chemistry of Additives, 1967, pp. 1-11.
Stohr, Torsten et al., A New Generation of High Performance Viscosity Modifiers Based on Comb Polymers, SAE Int. J. Fuels Lubr., 2008, pp. 1511-1516, vol. 1, Issue 1, Evonik.

* cited by examiner

*Primary Examiner* — Ellen M McAvoy
(74) *Attorney, Agent, or Firm* — Orrick, Herrington & Sutcliffe LLP; Joong Youn Cho

(57) ABSTRACT

Automotive transmission fluid compositions are provided having improved power transmission properties through the presence therein of certain defined additives, which increase the fuel efficiency of the vehicle during operation. The invention further provides a process for the manufacture of such transmission fluid compositions, a method of improving the energy efficiency of a transmission, and an additive concentrate for a transmission fluid.

33 Claims, No Drawings

AUTOMOTIVE TRANSMISSION FLUID COMPOSITIONS FOR IMPROVED ENERGY EFFICIENCY

The present invention provides automotive transmission fluid compositions having improved power transmission properties through the presence therein of certain defined additives. In particular, the invention provides transmission fluid compositions for automotive vehicles, the use of which increase the fuel efficiency of the vehicle during operation. The invention further provides a process for the manufacture of such transmission fluid compositions, a method of improving the energy efficiency of a transmission, and an additive concentrate for a transmission fluid, and other aspects as hereinafter described.

Political, regulatory and consumer pressures abound to increase the energy efficiency of the modern world. Machines for many applications rely on co-operation between moving parts to transmit power from drive units to driven units, and the efficiency of this power transmission contributes to the overall energy efficiency of the machine. The pursuit of ever more energy-efficient machines has become a constant goal in many industry sectors.

In the automotive sector, power transmission occurs primarily through the drive-train components of the vehicle. The crankshaft of the engine is typically coupled to the transmission through some form of clutch, with power transmission occurring across the clutch to drive the transmission and ultimately the wheels. Further clutches may be present within the transmission depending upon the design of the vehicle and its transmission type. An essential characteristic of such clutches is their ability to efficiently transmit power across the contact between the clutch plates. Any losses in power transmission between the engine and wheels result in reduced energy efficiency for the vehicle, as demonstrated for example by poorer fuel efficiency.

Improving the energy efficiency of automotive transmissions via the automotive transmission fluid presents challenges different to improving the energy efficiency of an engine. In general terms, energy losses occur in moving engine parts due to friction. A common goal in the lubrication of engines is therefore to reduce friction and, in so doing, reduce attendant energy losses. In contrast, transmissions function by transmitting power across moving surfaces via high friction. Therefore, creating an environment of low friction between these surfaces would lead to a loss of energy transfer between the surfaces and attendant loss in power transmitted by the transmission. At the same time, however, wear must be controlled. Thus, the formulation of effective transmission fluids having a beneficial balance of clutch friction, wear, fatigue prevention and energy efficiency is a complex task, and not one that readily lends itself to routine analysis.

There remains in the art a need for improved automotive transmission fluids which, in use, lead to increased energy efficiency of the transmission and, in particular, there remains a need in the art for automotive transmission fluids which lead to increased fuel efficiency for the vehicle during operation.

An approach to this problem described in the art concerns the modification of transmission fluid viscosity through the use of viscosity modifiers. By altering the viscometric properties of the fluid, i.e. lowering the fluid viscosity, some benefits in fuel efficiency have been seen in given cases. However, this effect has been attributed to the physical impact of altered bulk liquid viscometrics, and has been associated with a number of disadvantages such as durability of mechanical parts and reliability of operation.

The present invention concerns automotive transmission fluid compositions having improved power transmission properties through the presence therein of certain defined additives. In particular, the invention provides transmission fluids for automotive vehicles, the use of which demonstrably increase the fuel efficiency of the vehicle during operation.

In particular, the present invention has determined that a class of polyalphaolefin polymer made by a particular form of polymerisation reaction has utility as a performance-enhancing additive for transmission fluids, when present in conjunction with one or more detergent additives and specific viscosity modifiers, wherein the combination functions to improve the power transmission properties of the fluid. This combination of additives enables the transmission to operate with greater energy efficiency, as demonstrated for example by an increase in the fuel efficiency of the vehicle during operation. The polyalphaolefin shows advantageous performance as an additive for this purpose when used in an amount that does not exceed 4 percent by weight of the total transmission fluid composition, and optimal performance when used in an amount in the range of 1 to 3 percent by weight of the total transmission fluid composition.

As the examples hereafter demonstrate, the energy efficiency benefit arising from the combination of polyalphaolefin, specific viscosity modifier and detergent additive is manifest even under conditions in which the main viscometric properties of the fluids under comparison (kinematic viscosity and viscosity index) have been controlled to remain essentially constant. Thus, the fundamental effect of the additive combination is seen to operate independent of fluid viscosity per se. The improvement in energy efficiency attributable to the combination of additives essential to the invention is thus attributed to a mechanism different from simply lowering the fluid viscosity by the approach known in the art.

US-A-2010/0035778 provides a composition for a power transmitting fluid that has inter alia improved fuel economy which preferably comprises an additive and a base stock having a polyalphaolefin blend. The additive preferably includes inter alia a viscosity index improver. This teaching reports the use of a basestock that includes a polyalphaolefin (PAO) or PAO blend that has an unconventional viscosity profile, and recites a fluid composition having from about 8% to about 90% by weight of the PAO blend. The worked example of the composition contains 77.4% by weight of the PAO blend, being comprised of PAO 2 cSt and PAO 6 cSt in proportions of 9.4% and 68.0% by weight respectively, along with a viscosity modifier and detergent additive. This teaching reports that any number of PAOs may be employed so long as the PAO blend is selected such that the base viscosity of the fluid is greater than or equal to 4.0 cSt at 100° C. This teaching fails to conceptually recognise the benefit arising from use of a specific polyalphaolefin at additive treat levels within the transmission fluid, and again focuses on altered bulk viscometrics as the means by which fluid performance is enhanced.

US-A-2007/000807 provides an industrial lubricant and grease composition containing high viscosity index polyalphaolefins (HVI-PAO) characterised by having a high viscosity index of preferably 130 or greater and certain other define characteristics. Such HVI-PAOs may be prepared by a variety of routes, including activated metallocene catalysts. The document teaches in paragraph 0016 that a particular advantage of its HVI-PAO formulations is that certain conventional additives are not required, particularly polymeric thickeners or other thickening fluids, eg. viscosity index (VI) improvers, although they may be included as an optional element.

The present invention has found that the nature of the viscosity modifier used in combination with the defined polyalphaolefin influences the degree of improvement in energy efficiency achieved through use of the resulting transition fluid composition, and in particular the degree of improvement in fuel efficiency of the vehicle. As described hereinafter, different viscosity modifiers demonstrate differential improvements in combination with the polyalphaolefin when compared in formulated oils having equivalent viscometric properties. This improvement in efficiency is therefore attributable to the nature of the viscosity modifier per se rather than to differential viscosity modification effects.

In addition, the present invention has found that the presence of at least one detergent additive increases the improvement in energy efficiency achieved through use of the resulting transition fluid composition, and in particular optimises the fuel efficiency of the vehicle. Preferably, for improving energy efficiency, at least one detergent additive (iv) comprises one or more alkaline earth metal detergent compounds, wherein at least one alkaline earth metal detergent compound is an alkaline earth metal salicylate or sulphonate compound. More preferably, each alkaline earth metal detergent compound present in the transmission fluid composition is a neutral or overbased calcium salicylate compound, and more preferably the total amount of these calcium salicylate compound(s) is such as to provide the transmission fluid composition with a calcium content of between 50 and 250 parts per million by weight, per weight of the transmission fluid composition.

In a first aspect therefore, the present invention provides a transmission fluid composition consisting of:

(i) a lubricating oil, or blend of lubricating oils;

(ii) a viscosity modifier additive or blend of viscosity modifier additives;

(iii) a polyalphaolefin compound or compounds; and (iv) one or more detergent/inhibitor additives, wherein the or each polyalphaolefin compound (iii) is made by the metallocene-catalysed polymerisation of an alphaolefin feedstock, and wherein the total amount of the polyalphaolefin compound(s) (iii) in the transmission fluid composition does not exceed 4 percent by weight of the composition; and wherein at least one viscosity modifier additive (ii) contains a polymer or blend of polymers selected from one or more of the following groups:

- (ii)(a) random or block poly-alkylacrylates or poly-alkylmethacrylates, or copolymers thereof;
- (ii)(b) star polymers comprising a polyvalent core of polyalkylacrylate or polyalkylmethacrylate from which a plurality or arms depend, the arms being polymer chains containing alkylacrylate or alkylmethacrylate monomer units; or
- (ii)(c) comb polymers prepared by the copolymerisation of one or more alkylacrylate or alkylmethacrylate monomers with one or more olefin or polyolefin monomers.

The, or each, polyalphaolefin compound (iii) is made by a polymerisation reaction in which the corresponding alphaolefin feedstock is polymerised through the action of a metallocene catalyst. Such polyalphaolefins are known per se, and are sometimes referred to in the polymer art as "mPAO". They possess a structure different from polyalphaolefins derived from other catalytic processes. In particular, the action of the metallocene catalyst is such as to cause the formation of a polymer product having a narrow molecular weight distribution, and a structure that embodies a high proportion of head-to-tail monomer unit additions, i.e. can be regarded as an essentially ideal polymer. The literature for such materials also reports a more ordered pattern of hydrocarbon side chains with fewer short side chains than other processes. The result is a polymer with a more "perfect" structure and different properties.

The present invention has determined that such polyalphaolefins show a particular benefit when used as performance-enhancing additives in transmission fluid compositions. As illustrated in the examples which follow, the additive benefit from such polyalphaolefins is seen at a treat rate of not more than 4 percent by weight of the total transmission fluid composition, preferably between 1 and 3 percent by weight, and optimally between 2 and 3 percent by weight. Such treat rates correspond to typical additive treat rates in such fluids, and are not to be confused with the use of synthetic polymers as lubricating oils per se (sometimes called "basestocks") or as basestock blending components, which involve the incorporation of larger relative quantities of polymer for constituting the bulk volume of base lubricating oil.

In a second aspect, the present invention provides a process for the manufacture of a transmission fluid composition, the composition consisting of:

(i) a lubricating oil, or blend of lubricating oils;

(ii) a viscosity modifier additive or blend of viscosity modifier additives containing a polymer or blend of polymers selected from one or more of the following groups:

- (ii)(a) random or block poly-alkylacrylates or poly-alkylmethacrylates, or copolymers thereof;
- (ii)(b) star polymers comprising a polyvalent core of polyalkylacrylate or polyalkylmethacrylate from which a plurality or arms depend, the arms being polymer chains containing alkylacrylate or alkylmethacrylate monomer units; or
- (ii)(c) comb polymers prepared by the copolymerisation of one or more alkylacrylate or alkylmethacrylate monomers with one or more olefin or polyolefin monomers;

(iii) a polyalphaolefin compound or compounds, each made by the metallocene-catalysed polymerisation of an alphaolefin feedstock; and (iv) one or more detergent/inhibitor additives;

the process comprising the following steps:

a) obtaining (by manufacture or otherwise) a lubricating oil or blend of lubricating oils containing no polyalphaolefin compound(s) made by the metallocene-catalysed polymerisation of an alphaolefin feedstock; and b) mixing with this lubricating oil or blend of lubricating oils the following:

- (b)(1) the viscosity modifier additive or blend of viscosity modifier additives (ii),
- (b)(2) the polyalphaolefin compound(s) (iii) in a total amount not exceeding 4 percent by weight of the transmission fluid composition, and
- (b)(3) one or more detergent/inhibitor additives (iv); to provide the transmission fluid composition.

In particular, the process of the present invention is employed to manufacture an automotive transmission fluid, wherein the additions in step b) improve the efficiency of power transmission provided by the resulting composition when used in the vehicle, as demonstrated by an increase in the fuel efficiency of the vehicle during operation.

In a third aspect, the present invention provides a method of improving the energy efficiency of an automotive transmission, comprising the use therein of the transmission fluid composition defined in the first aspect or of the transmission fluid composition obtained by the process of the second aspect. In this aspect of the invention, the transmission is a transmission for an automotive vehicle, and the improvement in energy efficiency is preferably an increase in fuel economy of the vehicle during operation.

In a fourth aspect, the invention provides an additive concentrate for an automotive transmission fluid, the concentrate consisting of a suitable carrier liquid, and (ii) a viscosity modifier or blend of viscosity modifiers, (iii) a polyalphaolefin compound or mixture of polyalphaolefin compounds made by the metallocene-catalysed polymerisation of an alphaolefin feedstock, and (iv) one or more detergent additives, all as defined in relation to the first aspect. Preferably at least one of the detergent additives comprises one or more alkaline earth metal detergent compounds wherein at least one alkaline earth metal detergent compound is an alkaline earth metal salicylate or sulphonate compound. Alternatively, or in addition, the total amount of polyalphaolefin compound(s) (iii) present in the concentrate is preferably such that, after addition of the concentrate at its specified treat rate to the transmission fluid, said compounds (iii) constitute no more than 4 percent by weight of the resulting transmission fluid composition.

The present invention is hereinafter described in more detail.

The transmission fluid composition consists of four essential elements (i), (ii), (iii) and (iv). The components are:

(i) a lubricating oil, or blend of lubricating oils;

(ii) a viscosity modifier additive or blend of viscosity modifier additives as hereinafter described;

(iii) a polyalphaolefin compound or compounds made by the metallocene-catalysed polymerisation of an alphaolefin feedstock; and (iv) one or more detergent/inhibitor additives.

It is essential that the total amount of the polyalphaolefin compound(s) (iii) in the transmission fluid composition does not exceed 4 percent by weight of the composition, regardless of the means of incorporation. Thus, in principle, it is possible in the practice of this invention that some, or all, of the small amount of polyalphaolefin(s) (iii) in the composition of the first aspect may be introduced to the composition via incorporation in the lubricating oil or oil blend (i). However, it is preferred that the lubricating oil or oil blend component (i) per se contains no such polyalphaolefins (iii), and that these essential compounds (iii) are instead incorporated into the composition by direct addition as a discrete additive in the process of manufacture of the composition, or are mixed with the viscosity modifier additive or blend of viscosity modifier additives (ii) to form a single additive concentrate prior to their addition to the lubricating oil or blend of oils. Alternatively, the polyalphaolefin compound(s) (iii) may be mixed with one or more of the detergent/inhibitor additive(s) (iv) to form a single additive concentrate prior to addition to the lubricating oil or blend of oils.

The most additive benefit from such polyalphaolefins (iii) when used in accordance with the invention is seen at a treat rate of below 4 percent by weight of the total transmission fluid composition, more preferably between 1 and 3 percent by weight, and optimally between 2 and 3 percent by weight of the total transmission fluid composition.

The lubricating oil or oil blend (i) constitutes the bulk of the fluid composition. Oils useful in this invention as the lubricating oil, or for constituting the oil blend, are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C. depending on the specification or quality of transmission fluid sought, although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 10.0 $mm^2/s$ (cSt) at 100° C. The preferred mineral oils have kinematic viscosities of from 2 to 8 $mm^2/s$ (cSt), and most preferred are those mineral oils with viscosities of 3 to 6 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly-(1-decenes), etc., and mixtures thereof]; alkylbenzenes (e.g., dodecyl-benzenes, tetradecylbenzenes, dinonyl-benzenes, di(2-ethylhexyl)benzene, etc. (polyphenyls (e.g., biphenyls, terphenyls, alkylated polyphenyls, etc.); and alkylated diphenyl ethers, alkylated diphenyl sulfides, as well as their derivatives, analogs, and homologs thereof, and the like.

The preferred oils from this class of synthetic oils are Group IV basestocks, i.e. polyalphaolefins (PAO), including hydrogenated oligomers of an alpha-olefin, particularly oligomers of 1-decene, especially those produced by free radical processes, Ziegler catalysis, or cationic, Friedel-Crafts catalysis.

The polyalphaolefins typically have viscosities in the range of 2 to 20 cSt at 100° C., preferably 4 to 8 cSt at 100° C. They may, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

As explained earlier however, in the context of the present invention, should the lubricating oil or lubricating oil blend (i) be additionally constituted from any polyalphaolefin (iii), i.e. mPAO made by the metallocene-catalysed polymerisation of an alphaolefin feedstock, it is important that such polyalphaolefins (iii) do not collectively contribute more than 4% by weight of the total transmission fluid composition.

Preferably, any and all polyalphaolefin(s) constituting the lubricating oil or lubricating oil blend (i) are not made by the metallocene-catalysed polymerisation of an alphaolefin feedstock.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000-1500); and mono- and poly-carboxylic esters thereof (e.g., the acetic acid esters, mixed $C_3$-$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils is adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Another class of suitable lubricating oils are those basestocks produced from oligomerization of natural gas feed stocks or isomerization of waxes. These basestocks can be referred to in any number of ways but commonly they are known as Gas-to-Liquid (GTL) or Fischer-Tropsch base stocks.

The lubricating oil (i) may be a blend of one or more of the above described oils, and a blend of natural and synthetic lubricating oils (i.e., partially synthetic) is expressly contemplated under this invention.

The viscosity modifier or blend of viscosity modifiers (ii) may be a single compound or a blend of compounds capable of modifying the viscosity of lubricating oil when added thereto, so as to make its viscosity profile more advantageous for lubricant function. Typically, lubricating oils experience a range of operating temperatures within the device being lubricated and, as viscosity is a temperature-dependent characteristic, must therefore maintain an appropriate viscosity throughout the range of operating temperatures, such that the oil neither becomes too viscous ('thick') at lower temperatures to cause viscous drag in the device, nor too thin to provide adequate lubrication at higher temperatures. Viscosity modifiers typically have the property of increasing the viscosity of the oil at higher temperatures, so offsetting the natural thinning of the lubricant base-stock, whilst having lesser (or no) thickening effect at lower temperatures, so as to not contribute substantially to viscous drag. In addition, preferred viscosity modifiers show a greater resistance to loss of activity over time, when exposed to the shear forces and other degrading effects that an automotive lubricant experiences during the rigours of operation.

In the practice of this invention, certain defined classes of viscosity modifier are used in combination with components (i), (iii) and (iv) to provide transmission fluid compositions with the advantages of the present invention.

Thus, the viscosity modifier or blend of viscosity modifiers (ii) is a polymer or blend of polymers derived from one or more olefin or unsaturated ester monomers; and more preferably a polymer or blend of polymers derived from one or more olefin monomers, or from one or more $\alpha$, $\beta$-unsaturated ester monomers such as alkyl acrylates and alkyl methacrylates, or from one or more olefins and one or more $\alpha$, $\beta$-unsaturated ester monomers such as alkyl acrylates and alkyl methacrylates.

Most preferably, the viscosity modifier or blend of viscosity modifiers (ii) is a polymer or blend of polymers selected from one or more of the following groups:

(ii)(a) random or block poly-alkylacrylates or poly-alkylmethacrylates, or copolymers thereof;

(ii)(b) star polymers comprising a polyvalent core of polyalkylacrylate or polyalkylmethacrylate from which a plurality or arms depend, the arms being polymer chains containing alkylacrylate or alkylmethacrylate monomer units; or (ii)(c) comb polymers prepared by the copolymerisation of one or more alkylacrylate or alkylmethacrylate monomers with one or more olefin or polyolefin monomers.

Materials in group (ii)(a) are prepared by the polymerisation of one or more alkylacrylate or alkylmethacrylate monomers, wherein the alkyl groups preferably contain from 1 to 20, more preferably 1 to 10 carbon atoms, using techniques known in the art, such as radical polymerisation. Such materials are known in the art and are commercially available, an example being VISCOPLEX® 12-075 supplied by Evonik Rohmax USA, Inc.

Materials in the group (ii)(b) are prepared by the stepwise polymerisation of a core portion from one or more alkylacrylate or alkylmethacrylate monomers, wherein the alkyl groups preferably contain from 1 to 30, more preferably 1 to 20 carbon atoms, followed by further polymerisation with such monomers to form the pendant arms. Suitable processes include atom transfer radical polymerisation (ATRP) and reversible addition-fragmentation chain transfer (RAFT) polymerisation. Alternatively the arms can be separately formed and attached to the core via reaction at the linking groups. Such materials are known in the art.

Materials in the group (ii)(c) are most conveniently prepared by radical polymerisation. The term "comb" is known in the polymer art, and refers to the comb-like architecture of the polymer which possesses a series of side-chains depending from the main backbone chain, these side-chains being formed either from the alkyl substituents of the alkyl acrylate or methacrylate monomer units, or from the residues of the olefin monomers, or both.

Preferably, where the comb polymer (ii)(c) is prepared from one or more alkylacrylate or alkylmethacrylate monomers, it is formed by the polymerisation of one or more alkylacrylate or alkylmethacrylate monomers wherein the alkyl chains contain between 4 and 20 carbon atoms, preferably by radical polymerisation.

Preferably, where the comb polymer (ii)(c) is prepared from one or more olefin or polyolefin monomers, it is formed by the polymerisation of one or more olefin monomers containing between 4 and 20, such as 4 to 12, carbon atoms. Alternatively, it may be prepared from one or more polyolefin macromonomers providing alkyl or alkenyl groups of considerable size, which form the side-chains of the resulting comb polymer structure.

More preferably, the comb polymer (ii)(c) is prepared by the copolymerisation of one or more alkylacrylate or alkylmethacrylate monomers with one or more olefin or polyolefin monomers. In such polymers, the backbone is formed by the co-polymerising (meth)acrylate and olefin or polyolefin monomer units, with the alkyl ester groups of the (meth)acrylate units and the residues of the olefin or polyolefin depending from the resulting backbone to form the comb structure. In such structures, the alkyl groups of the alkylacrylate or alkylmethacrylate monomers preferably contain between 4 and 20, such as 8 to 18, carbon atoms; whilst the co-monomer is preferably an olefin or polyolefin providing a longer dependant chain to the resulting copolymer, such as a long chain alpha-olefin or a polyolefin macromonomer such as poly(isobutylene) or hydrogenated poly(butadiene). Further, olefinically unsaturated comonomers may be used in the preparation, for example styrene or $\alpha$, $\beta$-unsaturated esters. When present in the lubricating oil, such polymers are capable of significant expansion when energy is applied (such as occurs when the oil heats up during operation), and this thermal expansion behaviour enables them to entrain more of the bulk oil within a fluid network of expanded comb structures, and so oppose the thinning in oil viscosity that otherwise typically occurs with increasing temperature.

Such materials are described, for example, in the SAE paper entitled "A New Generation of High Performance Viscosity Modifiers Based on Comb Polymers" by Stoehr, Eisenberg and Mueller, published in *SAE Int. J. Fuels Lubr.*, Volume 1, Issue 1, 1511 and numbered as 2008-0102462, and in US-A-2010/0190671 which describes their nature and preparation.

Whilst polymer(s) from the above groups (ii)(a), (ii)(b) and (ii)(c) are all favoured for the practice of this invention, differentiation in the magnitude of that effect is seen between the three classes, whilst maintaining the overall viscometrics of the oils as equal as practically possible, to confirm that such differential effects are not accounted for by the conventional approach of variation in bulk oil viscosity. Thus, polymers from the class (ii)(c) were most effective in combination with the other essential elements (i), (iii) and (iv) for increasing fuel economy, and are most preferred for the practice of this invention. Class (ii)(a) is least preferred.

The polyalphaolefin compound or compounds (iii) are those by the metallocene-catalysed polymerisation of an alphaolefin feedstock. Such "mPAO" materials are known in the art per se and are described, for example, in US-A-2007/145924 along with their method of manufacture via metallocene catalysis. In this reference they are described as a lubricant base-stock component and used primarily to make high viscosity basestock blends. They are for example available to the skilled person as items of commerce under the name "SpectraSyn Elite™" from ExxonMobil Chemical Company and its regional sales affiliates, and further disclosed in the art at the date of filing at the following web address: http://www.exxonmobilchemical.com/Chem-English/brands/spectrasyn-elite-mpao.aspx? ln= under the description of "Advanced synthetic basestock". The performance advantages of SpectraSyn Elite™ as a lubricant basestock are described in that reference as shear stability, viscosity index for high and low temperature performance, and increased flow in cold environments. The reference also explains that the use of metallocene catalysis in the manufacture of the mPAO results in a particular molecular structure in the polymer product.

In the present invention, the polyalphaolefin compound(s) (iii) are used in additive quantities in the transmission fluid composition in combination with a viscosity modifier additive or blend of viscosity modifier additives (ii) and specific detergent/inhibitor additives(s) (iv) to improve the energy efficiency of a transmission utilising said fluid. Metallocene-made polyalphaolefins (iii) having characteristics particularly suitable for the practice of this invention can be produced from a feedstock containing one or more, preferably two or more, linear $C_6$ to $C_{18}$ alphaolefins. Preferred polyalphaolefins (iii) are those made from a feedstock mixture of $C_6$ and $C_{18}$ linear alphaolefins or a mixture of $C_6$ and $C_{12}$ alphaolefins. The feedstock is typically contacted with an activated metallocene catalyst under polymerisation conditions known in the art, to give the compounds (iii).

In the preferred embodiment of the invention, and the examples which follow hereafter, the invention employs SpectraSyn Elite™ 150 as the polyalphaolefin (iii). This material is available as an item of commerce through the above source according to a published specification, and has a typical kinematic viscosity at 100° C. of 156 $mm^2/s$ as measured by ASTM D445, and a typical viscosity index of 206 as measured by ASTM D2270, together with a pour point of minus 33° C. as measured by ASTM D5950/D97.

In addition to the essential metallocene-derived polyalphaolefin (iii) in the requisite amount, the compositions of the invention may, via additive (iv), additionally contain other non-essential polyalphaolefins.

The present invention concerns automotive transmission fluid compositions having improved power transmission properties, in particular those which demonstrably increase the fuel efficiency of the vehicle during operation. Thus, the transmission fluid composition of the invention is an automotive transmission fluid, such as an automatic transmission fluid (hereinafter referred to as "ATF"), continuously variable transmission fluid ("CVTFs"), or double clutch transmission fluid ("DCTFs").

Such fluids are formulated with a detergent additive (iv) to meet the various performance requirements and/or specifications of a given application, especially automotive application. Within this specification, the term "detergent/inhibitor additive(s)" is used to denote an additive comprising one or more detergent compounds, and optionally other compounds ('components') which function as performance-enhancing additives for transmission fluids. In the art, such detergent/inhibitor additives are sometimes generally known as detergent packages or detergent-inhibitor packages, and may contain a variety of other components and a mutually-compatible solvent or dispersion medium.

These other components include dispersants, antiwear agents, friction modifiers, corrosion inhibitors, extreme pressure additives, and the like. They are typically disclosed in, for example, "Lubricant Additives" by C. V. Smallheer and R. Kennedy Smith, 1967, pp. 1-11 and U.S. Pat. No. 4,105,571.

Representative amounts of typical components of additive (iv) in an automotive transmission fluid are summarized as follows:

| Additive | (Broad) Wt. % | (Preferred) Wt. % |
|---|---|---|
| Dispersants | 0.10-10 | 2-5 |
| Antiwear Agents | 0.005-5 | 0.5-3 |
| Friction modifiers | 0.05-5 | 0.5-3.0 |
| Corrosion Inhibitor | 0.01-3 | 0.02-1 |
| Antifoaming Agents | 0.001-5 | 0.001-0.5 |
| Pour Point Depressants | 0.01-2 | 0.01-1.5 |
| Seal Swellants | 0.1-8 | 0.5-5 |
| Diluent | Balance | Balance |

It is preferred that at least one additive (iv) comprises one or more alkaline earth metal detergent compounds wherein at least one alkaline earth metal detergent compound is an alkaline earth metal salicylate or sulphonate compound, leading to further improvement of the energy efficiency of the resulting fluid, as hereinbefore described.

The preferred detergents that are generally employed in the invention are exemplified by oil-soluble neutral or overbased salts of alkaline earth metals with one or more hydrocarbyl-substituted sulfonic acids or salicylic acids. The preferred salts of such acids from the cost-effectiveness, toxicological, and environmental standpoints are the salts of calcium and magnesium. The more preferred salts useful with this invention are either neutral or overbased salicylate salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C.

Examples of suitable metal-containing detergents are neutral and overbased salts of calcium sulfonates and magnesium sulfonates wherein each sulfonic acid moiety is attached to an aromatic nucleus which in turn usually contains one or more aliphatic substituents to impart hydrocarbon solubility, and calcium salicylates and magnesium salicylates wherein the aromatic moiety is usually substituted by one or more aliphatic substituents to impart hydrocarbon solubility. Mixtures of neutral or over-based salts of two or more different alkaline earth metals can be used. Likewise, neutral and/or overbased salts of mixtures of two or more different acids (e.g. one or more overbased calcium salicylates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Methods for the production of these oil-soluble neutral and overbased alkaline earth metal-containing detergents are well known to those skilled in the art, and extensively reported in the patent literature.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; and 4,965,004.

Most preferred metallic detergents for use with this invention are calcium sulfonates and/or magnesium sulfonates, and calcium and/or magnesium salicylates. Preferably at least one such alkaline earth metal detergent compound is a calcium salicylate or calcium sulphonate compound. Preferably, the total amount of the alkaline earth metal detergent compound(s) present in the transmission fluid composition is such as to provide the transmission fluid composition with a an alkaline earth metal content of between 50 and 250 parts per million by weight, per weight of the transmission fluid composition.

More preferably, each alkaline earth metal detergent compound present in the transmission fluid composition is a neutral or overbased calcium salicylate compound. Salicylate compounds have been found to be particularly advantageous in combination with the additives (ii) and (iii) described herein and contribute to the fuel efficiency advantage of the present invention.

Most preferably each alkaline earth metal detergent compound present in the transmission fluid composition is a neutral or overbased calcium salicylate compound, and wherein the total amount of the calcium salicylate compound(s) present is such as to provide the transmission fluid composition with a calcium content of between 50 and 250 parts per million by weight, per weight of the transmission fluid composition, this amount having been found to provide optimal efficiency gains.

Dispersants, specifically those characterised as ashless dispersants, are also useful in this invention as components of additive (iv). Suitable dispersants include long chain (i.e. greater than forty carbon atoms) substituted hydrocarbyl succinimides and hydrocarbyl succinamides, mixed ester/amides of long chain (i.e. greater than forty carbon atoms)

hydrocarbyl-substituted succinic acid, hydroxyesters of such hydrocarbyl-substituted succinic acid, and Mannich condensation products of long chain (i.e. greater than forty carbon atoms) hydrocarbyl-substituted phenols, formaldehyde and polyamines. Mixtures of such dispersants can also be used.

The preferred dispersants are the long chain alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025; 3,502,677; and 4,857,214).

Anti-wear additives useful in this invention as components in additive (iv) are typically oil-soluble phosphorus-containing compounds that, in the context of this invention, may vary widely and are not limited by chemical type. The only limitation is that the material be oil soluble so as to permit the dispersion and transport of phosphorus-containing compound within the lubricating oil system to its site of action. Examples of suitable phosphorus compounds are: phosphites and thiophosphites (mono-alkyl, di-alkyl, tri-alkyl and partially hydrolyzed analogs thereof); phosphates and thiophosphates; amines treated with inorganic phosphorus such as phosphorous acid, phosphoric acid or their thio analogs; zinc dithiodiphosphates; amine phosphates. Examples of particularly suitable phosphorus compounds include: mono-n-butyl-hydrogen-acid-phosphite; di-n-butyl-hydrogen phosphite; triphenyl phosphite; triphenyl thiophosphite; tri-n-butylphosphate; dimethyl octadecenyl phosphonate, 900 MW polyisobutenyl succinic anhydride (PIBSA) polyamine dispersant post treated with $H_3PO_3$ and $H_3BO_3$ (see e.g., U.S. Pat. No. 4,857,214); zinc (di-2-ethylhexyldithiophosphate).

The preferred oil soluble phosphorus compounds are the esters of phosphoric and phosphorous acid. These materials would include the di-alkyl, tri-alkyl and tri-aryl phosphites and phosphates. A preferred oil soluble phosphorus compound is the mixed thioalkyl phosphite esters, for example as produced in U.S. Pat. No. 5,314,633, incorporated herein by reference.

The phosphorus compounds of the invention can be used in the oil in any effective amount. However, a typical effective concentration of such compounds would be that delivering from about 5 to about 5000 ppm phosphorus into the oil. A preferred concentration range is from about 10 to about 1000 ppm of phosphorus in the finished oil and the most preferred concentration range is from about 50 to about 500 ppm.

Preferred friction modifiers useful as components in additive (iv) comprise a reaction product of an isomerized alkenyl substituted succinic anhydride and a polyamine characterized by structure (I), where structure (I) is:

(I)

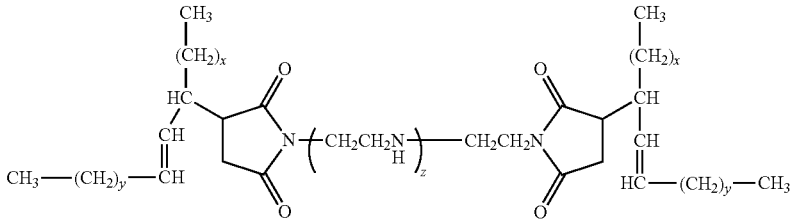

where x and y are independent integers, the sum of which is from 1 to 30, and z is an integer from 1 to 10.

The starting components for forming the structure (I) compounds are isomerized alkenyl succinic anhydrides which are prepared from maleic anhydride and internal olefins i.e., olefins which are not terminally unsaturated and therefore do not contain the

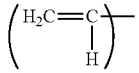

moiety. These internal olefins can be introduced into the reaction mixture as such, or they can be produced in situ by exposing alpha-olefins to isomerization catalysts at high temperatures. A process for producing such materials is described in U.S. Pat. No. 3,382,172. The isomerized alkenyl substituted succinic anhydrides have the structure shown as structure (II), where structure (II) is represented by:

(II)

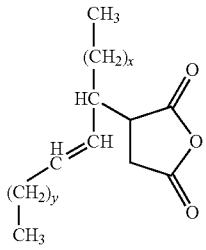

where x and y are independent integers, the sum of which from 1 to 30.

The preferred succinic anhydrides are produced from isomerization of linear alpha-olefins with an acidic catalyst followed by reaction with maleic anhydride. The preferred alpha-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The isomerized alkenyl succinic anhydrides are then further reacted with polyamines of structure (III), where structure (III) is represented by:

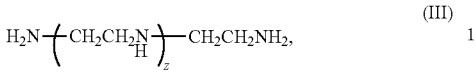

(III)

where z is an integer from 1 to 10, preferably from 1 to 3.

These are common polyethylene amines. When z=1 the material is diethylene triamine, when z=2 the material is triethylene tetramine, when z=3 the material is tetraethylene pentamine, for products where z>3 the products are commonly referred to as 'polyamine' or PAM. The preferred products of this invention employ diethylene triamine, triethylene tetramine, tetraethylene pentamine or mixtures thereof.

The isomerized alkenyl succinic anhydrides (II) are typically reacted with the amines in a 2:1 molar ratio so that both primary amines are converted to succinimides. Sometimes a slight excess of isomerized alkenyl succinic anhydride (II) is used to insure that all primary amines have reacted. The products of the reaction are shown as structure (I).

The di-succinimides of structure (I) may be further post-treated by any number of techniques known in the art. These techniques would include, but not be limited to: boration, maleation, acid treating with inorganic acids such as phosphoric, phosphorous, and sulfuric. Descriptions of these processes can be found in, for example, U.S. Pat. Nos. 3,254,025; 3,502,677; 4,686,054; and 4,857,214.

Other useful derivatives of these preferred friction modifiers are where the isomerized alkenyl groups of structures (I) and (II) have been hydrogenated to form their saturated alkyl analogs. These saturated versions of structures (I) and (II) may likewise be post-treated as previously described.

While any effective amount of the compounds of structure (I) and its derivatives may be used in additive (iv) of this invention, typically these effective amounts will range from 0.5 to 10, preferably from 2 to 7, most preferably from 3 to 6 weight percent of the finished fluid.

The various chosen components of additive (iv) of this invention may be combined in the form of a concentrate. Typically the active ingredient (a.i.) level of the concentrate will range from 20 to 90%, preferably from 25 to 80%, most preferably from 35 to 75 weight percent of the concentrate. The balance of the concentrate is a diluent typically comprised of a diluent or solvent.

The process of the present invention provides for the manufacture of an automotive transmission fluid composition, the composition consisting of:

(v) a lubricating oil, or blend of lubricating oils;

(vi) a viscosity modifier additive or blend of viscosity modifier additives as defined above in relation to the first aspect of the invention;

(vii) a polyalphaolefin compound or compounds, each made by the metallocene-catalysed polymerisation of an alphaolefin feedstock; and (viii) one or more detergent additives; the process comprising the following steps:

a) obtaining (by manufacture or otherwise) a lubricating oil or blend of lubricating oils containing no polyalphaolefin compound(s) made by the metallocene-catalysed polymerisation of an alphaolefin feedstock; and b) mixing with this lubricating oil or blend of lubricating oils the following:

(b)(1) the viscosity modifier additive or blend of viscosity modifier additives (ii), (b)(2) the polyalphaolefin compound(s) (iii) in a total amount not exceeding 4 percent by weight of the transmission fluid composition, and (b)(3) one or more detergent/inhibitor additives (iv);

to provide the transmission fluid composition.

Preferably, the additions in step b) improve the efficiency of power transmission provided by the composition in use, as demonstrated by an increase in the fuel efficiency of the vehicle during operation.

In the process, the polyalphaolefin compound(s) (iii) are preferably mixed with one or more of the detergent/inhibitor additives (iv) to form a single additive concentrate prior to addition to the lubricating oil or blend of oils.

Preferably, in the process, the total amount of the polyalphaolefin compound or compounds (iii) mixed with the lubricating oil or blend of lubricating oils is in the range of 2 to 3 percent by weight of the transmission fluid composition.

Also preferably in the process, at least one of the detergent/inhibitor additives (iv) comprises one or more alkaline earth metal detergent compounds wherein at least one alkaline earth metal detergent compound is an alkaline earth metal salicylate or sulphonate compound. More preferably, each alkaline earth metal detergent compound mixed with the transmission fluid composition is a neutral or overbased calcium salicylate compound. Most preferably, when each alkaline earth metal detergent compound mixed with the transmission fluid composition is a neutral or overbased calcium salicylate compound, the total amount of calcium salicylate compound(s) mixed with the lubricating oil or blend of lubricating is such as to provide the transmission fluid composition with a calcium content of between 50 and 250 parts per million by weight, per weight of the transmission fluid composition.

The invention further provides a method of improving the energy efficiency of an automotive transmission, comprising the use therein of the transmission fluid composition defined in the first aspect, or of the transmission fluid composition obtained by the process of the second aspect.

Preferably, in this method, the improvement in energy efficiency is an increase in fuel economy of the vehicle during operation.

The invention further provides an additive concentrate for an automotive transmission fluid, the concentrate consisting of a suitable carrier liquid, and (ii) a viscosity modifier or blend of viscosity modifiers, (iii) a polyalphaolefin compound or mixture of polyalphaolefin compounds made by the metallocene-catalysed polymerisation of an alphaolefin feedstock, and (iv) one or more detergent/inhibitor additives, all as defined above in relation to the first aspect.

Preferably, the total amount of polyalphaolefin compound(s) (iii) present in the concentrate is such that, after addition of the concentrate at its specified treat rate to the transmission fluid, said compounds (iii) constitute no more than 4 percent by weight of the resulting transmission fluid composition.

Preferably, in the additive concentrate, the total amount of the polyalphaolefin compound or compounds (iii) in the composition is in the range of 2 to 3 percent by weight of the composition.

Also preferably, in the additive concentrate at least one of the detergent additives (iv) comprises one or more alkaline earth metal detergent compounds wherein at least one alkaline earth metal detergent compound is an alkaline earth metal salicylate or sulphonate compound, which compound is preferably a neutral or overbased calcium salicylate compound.

In the process, method and concentrate aspects of the invention, the other preferments for each of the components (i), (ii), (iii) and (iv) is as stated previously in relation to the composition of the first aspect.

EXAMPLES

The following examples are given as specific illustrations of the claimed invention. It should be understood, however, that the invention is not limited to the specific details set forth in the examples. All parts and percentages are by weight per weight of the resulting transmission fluid composition, unless otherwise specified.

Worked Example 1—Benefit of Additive Treat Levels of the Polyalphaolefin (iii)

The essentiality of the defined metallocene-derived polyalphaolefin in the invention is demonstrated by back-to-back tests conducted on transmission fluids with and without this material present.

Four automotive transmission fluids were prepared according to the process aspect of the invention, by blending together the components shown in Table 1. In each case the components (i), (ii), (iv) were the same, and the fluids differ chemically only in the presence or absence of the polyalphaolefin (iii).

TABLE 1

| Component (% by weight, per weight of finished composition) | Composition 1 | Composition 1C (comparative) | Composition 2 | Composition 2C (comparative) |
|---|---|---|---|---|
| Base lubricating oil | 83.7 | 86.3 | 83.3 | 85.1 |
| Viscosity modifier | 3.0 | 3.0 | 2.0 | 4.2 |
| Pour point depressant | 0.3 | 0.2 | 0.2 | 0.2 |
| mPolyalphaolefin | 2.5 | — | 4.0 | — |
| Detergent additive: | | | | |
| Overbased calcium salicylate | 0.08 | 0.08 | 0.08 | 0.08 |
| Overbased calcium sulphonate | — | — | — | — |
| Other components | 10.42 | 10.42 | 10.42 | 10.42 |
| KV 40° C. | 19.84 | 17.73 | 19.23 | 18.69 |
| KV 100° C. | 4.77 | 4.37 | 4.63 | 4.69 |

In these compositions, the base lubricating oil, viscosity modifier, pour point depressant and detergent additive were the same in each case, and the blends differed only in the relative proportions of these constituents and, in the case of Compositions 1C and 2C, in the absence of the mPAO.

The mPolyalphaolefin was SpectraSyn Elite™ 150, an item of commerce from Exxonmobil Chemical Company. The detergent additive contained overbased calcium salicylate and additionally contained other components being dispersant, anti-wear, and other minor active components typical of a detergent additive package, combined with a small amount of base oil and diluent. These other components of the detergent additive were the same in each case. The viscosity modifier was VISCOPLEX® 12-199, available as an item of commerce from Evonik Rohmax USA, Inc. and falling within the class (ii)(c) described earlier in relation to suitable viscosity modifiers. The pour point depressant was a typical commercially available material and the same in each case.

The performance of these compositions was tested in the following two experiments.

A bench-test experiment called the "FE-8" test measures the torque required to rotate a radial thrust roller bearing assembly lubricated by the transmission fluid in question. The efficiency of the formulations was tested by measuring torque to rotate the cylindrical roller bearings at various conditions using an FE-8 radial thrust roller bearing tester. The bearings used are 15 roller FAG/INA 81212 bearings. The bearings were installed in the test rig and then preloaded to 60 kN. The bearings are run-in for 20 hours at 500 rpm at 100° C. prior to taking any measurement.

For each test fluid, the test head is heated until the bearing temperature reaches 40° C. While maintaining this temperature, bearings are rotated at 10 rpm for 10 mins then at 100 rpm and 500 rpm for 5 mins each. The reported torque at each condition is calculated by averaging the torque reading during the last 1 minute of the condition. Temperature is then increased to 80° C. and then finally to 120° C. and torque is measured with the same procedure at the three speeds. After this, the rig is cooled down to room temperature and the whole process is repeated. Final test results are the average of two repeats at each temperature and speed.

The FE-8 test thus compares the energy requirements needed to achieve defined bearing rotation with different fluids. Achieving the defined rotations with lower applied torque indicates greater energy efficiency within the mechanical system.

A vehicle test experiment was conducted according to the standard US Federal Test Procedure 75 ("FTP 75"). A commercially-available SUV with six speed automatic transmission was repeatedly run on a vehicle dynamometer according to the operating cycle specified in FTP 75, and in each case the improvement in fuel economy observed for the transmission fluid employed in the test is reported (as % improvement) over a reference fluid.

The FTP 75 provides a direct measure of fuel economy observed in vehicle operation. A positive percentage indicates greater fuel efficiency compared to reference.

In an FE-8 test, fluid compositions 1, 1C and 2C were compared for energy efficiency. The results are shown in Table 2 below. As can be seen, composition 1 consistently required lower applied torque to achieve rotations of 100 and 500 rpm in the FE-8 test, indicating improved energy efficiency for composition 1 (with polyalphaolefin (iii) at 2.5%) as compared to compositions 1C (and 2C) (no polyalphaolefin (iii)). In this screener test, the presence of polyalphaolefin (iii) shows an overall benefit for energy efficiency.

TABLE 2

| FE-8 Torque, NM | Composition 1 | Composition 1C | Composition 2C |
|---|---|---|---|
| 40° C., 100 rpm | 26.3 | 27.0 | 27.1 |
| 40° C., 500 rpm | 21.2 | 21.7 | 21.9 |
| 80° C., 100 rpm | 30.2 | 31.2 | 30.9 |
| 80° C., 500 rpm | 23.3 | 24.4 | 24.1 |
| 120° C., 100 rpm | 30.1 | 30.6 | 30.9 |
| 120° C., 500 rpm | 23.1 | 23.9 | 24.2 |

In particular, the compared samples were blended to have similar kinematic viscosity behaviour, thus eliminating the possibility of viscosity differences accounting for the differences in measured torque. Comparing the results for compositions 1C and 2C further demonstrates that the small residual differences in the KV values of these samples do not account for the differences in torque seen between composition 1 and composition 1C, which must therefore be attributable to the effect of polyalphaolefin (iii). For example, composition 2C had a KV 100 of 4.69, almost identical to that of composition 1 (4.77), yet at 120° C. the torque results for composition 2C are even higher than those for composition 1C, indicating that the better results obtained for composition 1 cannot be explained by reference to viscosity behaviour per se.

In FTP 75 vehicle tests, composition 1 (polyalphaolefin (iii) at 2.5%) was compared to the test reference fluid (contains no polyalphaolefin (iii)) and to composition 2 ((polyalphaolefin (iii) at the higher treat rate of 4%). The percentage improvement in fuel economy over the whole test was 0.86% for composition 1, compared to only 0.42% for composition 2. Thus the fuel efficiency benefit of polyalphaolefin (iii) in the composition showed an optimum at the treat rate of 2.5%, and at a higher treat rate of 4% the fuel efficiency benefit had dropped off considerably, confirming the benefit seen is one attributable to additive-level proportions of polyalphaolefin (iii).

Worked Example 2—Benefit of the Specific Viscosity Modifiers (ii)

The fuel efficiency effect of the defined viscosity modifiers (ii) in the invention is demonstrated by further comparative tests.

Two further automotive transmission fluids were prepared according to the process aspect of the invention, by blending together the components shown in Table 3. These fluids were tested alongside composition 1 from Table 1 in the FTP 75 vehicle test to compare the effect of changing viscosity modifier chemistry on fuel efficiency in the formulations of the invention.

The vehicle test experiment was again conducted according to the standard US Federal Test Procedure 75 ("FTP 75"), using the same commercially-available SUV with six speed automatic transmission on a vehicle dynamometer. In each case the improvement in fuel economy observed for the transmission fluid employed in the test is again reported (as % improvement) over reference fluid.

TABLE 3

| Component (% by weight, per weight of finished composition) | Composition 3 | Composition 4 |
|---|---|---|
| Base lubricating oil | 83.0 | 84.7 |
| Viscosity modifier 1 | — | — |
| Pour point depressant | — | — |
| Viscosity modifier 2 | 4.0 | — |
| Viscosity modifier 3 | — | 2.8 |
| mPolyalphaolefin | 2.5 | 2.0 |
| Detergent additive: | | |
| Overbased calcium salicylate | 0.08 | 0.08 |
| Other components | 10.42 | 10.42 |
| KV 40° C. | 20.74 | 20.47 |
| KV 100° C. | 4.72 | 4.76 |

Viscosity modifier 2 was VISCOPLEX®12-075, available as an item of commerce from Evonik Rohmax Additives GmbH and being a solution of polyalkyl methacrylate in diluent oil, ie a viscosity modifier of class (ii) (a) as described herein. Viscosity modifier 3 was LUBRIZOL® 87725, also available as an item of commerce from Lubrizol Corporation and being a viscosity modifier of class (ii)(b) as defined herein.

Composition 1 (from Example 1 above, containing Viscosity modifier 1) showed a fuel economy improvement over the total FTP 75 test of 0.86%. Composition 3 (Viscosity modifier 2—VISCOPLEX® 12-075) showed a lesser improvement of 0.37%, whilst Composition 4 (Lubrizol® 87725) showed an intermediate fuel economy result of 0.54%.

In each case, the level of viscosity modifier in the composition was chosen having regard to maintaining the viscosity behavior of the transmission fluid as consistent as practically possible between compositions, so as to exclude conventional bulk viscosity effects from the equation and demonstrate the particular advantages of specific viscosity modifiers in the present invention.

Worked Example 3—Comparison with Existing Base-Stock Approach in the Art

The ability of the present invention to achieve fuel efficiency improvements through additive-level quantities of the specific polyalphaolefin (iii), detergent/inhibitor additive (iv) and viscosity modifier (ii) was compared to the prior art PAO basestock approach described in US-A-2010/0035778 referred to above.

US-A-2010/0035778 (to GM Global Technology Operations Inc.) exemplifies a composition comprising 9.4% (by weight, per total weight of fluid) of a first polyalphaolefin (PAO 2 cSt) and 68.0% of a second polyalphaolefin (PAO 6 cSt), together with proprietary additives comprising the additive package Hitec® 3491 plus viscosity index improver and ester to a total of 22.6% by weight of the composition. The reference claims a fuel economy benefit for such compositions.

The performance of Composition 1 of the present invention was compared to a commercially-obtained GM automatic transmission fluid (GM ATF 212-B), having a reported PAO composition the same as that of the example from US-A-2010/0035778, and likewise a total additive content of 22.6% (Hitec 3941A). This composition was therefore considered illustrative of the invention exemplified in US-A-2010/0035778.

The performance of Composition 1 in the FTP 75 test has been noted as 0.86% fuel economy improvement over the whole test. In contrast, the GM ATF 212-B sample gave a result in the same test of 0.12% improvement in fuel economy over the reference fluid. Thus, Composition 1 showed substantially better fuel economy than the invention described in US-A-2010/0035778.

US-A-2010/0035778 teaches a solution for fuel economy that requires the blend of two PAOs of differing viscosities as the basestock for the transmission fluid. As shown by the above results, a greater improvement in fuel economy is surprisingly obtained from the composition of the present invention.

What is claimed is:

1. An automotive transmission fluid composition consisting essentially of:

(i) a lubricating oil, or blend of lubricating oils;

(ii) a viscosity modifier additive or blend of viscosity modifier additives;

(iii) a polyalphaolefin compound or compounds consisting of linear $C_6$ to $C_{18}$ alphaolefin monomer units; and (iv) one or more detergent/inhibitor additives, wherein the polyalphaolefin compound(s) (iii) is made by the metallocene-catalysed polymerisation of an alphaolefin feedstock, wherein the alphaolefin feedstock consists of one or more linear $C_6$ to $C_{18}$ alphaolefins, and wherein the total amount of the polyalphaolefin compound(s) (iii) in the transmission fluid composition does not exceed 4 percent by weight of the composition; and wherein at least one viscosity modifier additive (ii) contains a polymer or blend of polymers selected from one or more of the following groups:

(ii)(a) random or block poly-alkylacrylates or polyalkylmethacrylates, or copolymers thereof;

(ii)(b) star polymers comprising a polyvalent core of polyalkylacrylate or polyalkylmethacrylate from which a plurality or arms depend, the arms being polymer chains containing alkylacrylate or alkylmethacrylate monomer units; or (ii)(c) comb polymers prepared by the copolymerisation of one or more alkylacrylate or alkylmethacrylate monomers with one or more olefin or polyolefin monomers.

2. The transmission fluid composition of claim 1, wherein the total amount of the polyalphaolefin compound or compounds (iii) in the composition is in the range of 2 to 3 percent by weight of the composition.

3. The transmission fluid composition of claim 1, wherein the viscosity modifier additive is, or the blend of viscosity modifiers comprises, one or more polymers selected from the groups (ii)(b) and/or (ii)(c).

4. The transmission fluid composition of claim 2, wherein the viscosity modifier additive is, or the blend of viscosity modifiers comprises, one or more polymers selected from the groups (ii)(b) and/or (ii)(c).

5. The transmission fluid composition of claim 3, wherein the viscosity modifier additive is, or the blend of viscosity modifiers comprises, one or more polymers from the group (ii)(c).

6. The transmission fluid composition of claim 4, wherein the viscosity modifier additive is, or the blend of viscosity modifiers comprises, one or more polymers from the group (ii)(c).

7. The transmission fluid of claim 1, wherein one or more detergent/inhibitor additives (iv) comprises one or more alkaline earth metal detergent compounds, wherein at least one alkaline earth metal detergent compound is an alkaline earth metal salicylate or sulphonate compound.

8. The transmission fluid of claim 7, wherein one or more detergent/inhibitor additives (iv) comprises a neutral or overbased calcium salicylate compound.

9. The transmission fluid composition of claim 7, wherein each alkaline earth metal detergent compound present in the transmission fluid composition is a neutral or overbased calcium salicylate compound, and wherein the total amount of the calcium salicylate compound(s) present is such as to provide the transmission fluid composition with a calcium content of between 50 and 250 parts per million by weight, per weight of the transmission fluid composition.

10. The transmission fluid composition of claim 1, wherein at least one detergent/inhibitor additive (iv) also comprises one or more dispersant, oxidation inhibitor and/or friction modifier compounds.

11. A process for the manufacture of an automotive transmission fluid composition, the composition consisting essentially of:

(i) a lubricating oil, or blend of lubricating oils;

(ii) a viscosity modifier additive or blend of viscosity modifier additives containing a polymer or blend of polymers selected from one or more of the following groups:

(ii)(a) random or block poly-alkylacrylates or polyalkylmethacrylates, or copolymers thereof;

(ii)(b) star polymers comprising a polyvalent core of polyalkylacrylate or polyalkylmethacrylate from which a plurality or arms depend, the arms being polymer chains containing alkylacrylate or alkylmethacrylate monomer units; or (ii)(c) comb polymers prepared by the copolymerisation of one or more alkylacrylate or alkylmethacrylate monomers with one or more olefin or polyolefin monomers;

(iii) a polyalphaolefin compound or compounds consisting of linear $C_6$ to $C_{18}$ alphaolefin monomer units, each made by the metallocene-catalysed polymerisation of an alphaolefin feedstock wherein the alphaolefin feedstock consists of one or more linear $C_6$ to $C_{18}$ alphaolefins; and (iv) one or more detergent/inhibitor additives;

the process comprising the following steps:

a) obtaining (by manufacture or otherwise) a lubricating oil or blend of lubricating oils containing no polyalphaolefin compound(s) made by the metallocene-catalysed polymerisation of an alphaolefin feedstock; and b) mixing with this lubricating oil or blend of lubricating oils the following:

(b)(1) the viscosity modifier additive or blend of viscosity modifier additives (ii), (b)(2) the polyalphaolefin compound(s) (iii) in a total amount not exceeding 4 percent by weight of the transmission fluid composition, and (b)(3) one or more detergent/inhibitor additives (iv);

to provide the transmission fluid composition.

12. The process of claim 11, wherein the total amount of the polyalphaolefin compound or compounds (iii) mixed with the lubricating oil or blend of lubricating oils is in the range of 2 to 3 percent by weight of the transmission fluid composition.

13. The process of claim 11, wherein the viscosity modifier additive is, or the blend of viscosity modifiers comprises, one or more polymers selected from the groups (ii)(b) and/or (ii)(c).

14. The process of claim 12, wherein the viscosity modifier additive is, or the blend of viscosity modifiers comprises, one or more polymers selected from the groups (ii)(b) and/or (ii)(c).

15. The process of claim 13, wherein the viscosity modifier additive is, or the blend of viscosity modifiers comprises, one or more polymers from the group (ii)(c).

16. The process of claim 14, wherein the viscosity modifier additive is, or the blend of viscosity modifiers comprises, one or more polymers from the group (ii)(c).

17. The process of claim 11, wherein one or more detergent/inhibitor additives (iv) comprises one or more alkaline earth metal detergent compounds, wherein at least one alkaline earth metal detergent compound is an alkaline earth metal salicylate or sulphonate compound.

18. The process of claim 12, wherein one or more detergent/inhibitor additives (iv) comprises one or more alkaline earth metal detergent compounds, wherein at least one alkaline earth metal detergent compound is an alkaline earth metal salicylate or sulphonate compound.

19. The process of claim 17, wherein one or more detergent additives (iv) comprises a neutral or overbased calcium salicylate compound.

20. The process of claim 18, wherein one or more detergent additives (iv) comprises a neutral or overbased calcium salicylate compound.

21. The process of claim 19 wherein each alkaline earth metal detergent compound mixed with the transmission fluid composition is a neutral or overbased calcium salicylate compound, and wherein the total amount of calcium salicylate compound(s) mixed with the lubricating oil or blend of lubricating is such as to provide the transmission fluid composition with a calcium content of between 50 and 250 parts per million by weight, per weight of the transmission fluid composition.

22. The process of claim 20 wherein each alkaline earth metal detergent compound mixed with the transmission fluid composition is a neutral or overbased calcium salicylate compound, and wherein the total amount of calcium salicylate compound(s) mixed with the lubricating oil or blend of lubricating is such as to provide the transmission fluid composition with a calcium content of between 50 and 250 parts per million by weight, per weight of the transmission fluid composition.

23. The process of claim 11, wherein the additions in step b) improve the efficiency of power transmission provided by the composition when in use as an automotive transmission fluid, as demonstrated by an increase in the fuel efficiency of the vehicle during operation.

24. The process of claim 12, wherein the additions in step b) improve the efficiency of power transmission provided by the composition when in use as an automotive transmission fluid, as demonstrated by an increase in the fuel efficiency of the vehicle during operation.

25. The process of claim 11, wherein the polyalphaolefin compound(s) (iii) are mixed with one or more of the detergent additives (iv) to form a single additive concentrate prior to addition to the lubricating oil or blend of oils.

26. The process of claim 12, wherein the polyalphaolefin compound(s) (iii) are mixed with one or more of the detergent additives (iv) to form a single additive concentrate prior to addition to the lubricating oil or blend of oils.

27. A method of improving the energy efficiency of an automotive transmission, comprising the use therein of the automotive transmission fluid composition defined in claim 1.

28. The method of claim 27, wherein the improvement in energy efficiency is an increase in fuel economy of the vehicle during operation.

29. A method of improving the energy efficiency of an automotive transmission, comprising the use therein of the automotive transmission fluid composition obtained by the process of claim 11.

30. The method of claim 29, wherein the improvement in energy efficiency is an increase in fuel economy of the vehicle during operation.

31. An additive concentrate for an automotive transmission fluid, the concentrate consisting essentially of (i) a suitable carrier liquid, (ii) a viscosity modifier or blend of viscosity modifiers, and (iii) a polyalphaolefin compound or mixture of polyalphaolefin compounds consisting of linear $C_6$ to $C_{18}$ alphaolefin monomer units made by the metallocene-catalysed polymerisation of an alphaolefin feedstock wherein the alphaolefin feedstock consists of one or more linear $C_6$ to $C_{18}$ alphaolefins, and (iv) one or more detergent/inhibitor additives;

wherein at least one viscosity modifier additive (ii) contains a polymer or blend of polymers selected from one or more of the following groups:

(ii)(a) random or block poly-alkylacrylates or poly-alkylmethacrylates, or copolymers thereof;

(ii)(b) star polymers comprising a polyvalent core of polyalkylacrylate or polyalkylmethacrylate from which a plurality or arms depend, the arms being polymer chains containing alkylacrylate or alkylmethacrylate monomer units; or (ii)(c) comb polymers prepared by the copolymerisation of one or more alkylacrylate or alkylmethacrylate monomers with one or more olefin or polyolefin monomers, wherein the total amount of polyalphaolefin compound (s) (iii) present in the concentrate is such that, after addition of the concentrate at its specified treat rate to the transmission fluid, said compounds (iii) constitute no more than 4 percent by weight of the resulting transmission fluid composition.

32. The additive concentrate of claim 31, wherein the total amount of the polyalphaolefin compound or compounds (iii) present in the concentrate is such that, after addition of the concentrate at its specified treat rate to the transmission fluid, said compounds (iii) constitute no more than 2 to 3 percent by weight of the composition.

33. The additive concentrate of claim 31, wherein at least one detergent additive (iv) present in the concentrate comprises one or more alkaline earth metal detergent compounds, wherein at least one alkaline earth metal detergent compound is an alkaline earth metal salicylate or sulphonate compound.

* * * * *